US006339199B1

(12) United States Patent
Chou et al.

(10) Patent No.: US 6,339,199 B1
(45) Date of Patent: Jan. 15, 2002

(54) TILT SWITCH

(76) Inventors: Tien-Ming Chou, No. 41, San-Hsi 5th St., Pei Dist., Taichung City; Akira Yang, No. 22, Ta-Hsi 8th St., Hsi-Hu Chen, Changhua Hsien, both of (TW)

( * ) Notice: Subject to any disclaimer, the term of this patent is extended or adjusted under 35 U.S.C. 154(b) by 0 days.

(21) Appl. No.: 09/875,610

(22) Filed: Jun. 6, 2001

(51) Int. Cl.[7] ..... H01H 35/14
(52) U.S. Cl. ..... 200/61.52
(58) Field of Search ..... 200/61.45 R–61.45 M

(56) References Cited

U.S. PATENT DOCUMENTS 3,706,867 A * 12/1972 Rand et al. ..... 200/61.52
4,001,185 A * 1/1977 Mitsui et al. ..... 200/61.45 R
4,628,160 A * 12/1986 Canevari ..... 200/61.45 R
4,833,281 A * 5/1989 Maples ..... 200/61.45 R
5,285,033 A * 2/1994 Ipcinski ..... 200/61.52
5,410,113 A * 4/1995 Mielke ..... 200/61.45 R

* cited by examiner

*Primary Examiner*—Michael Friedhofer
(74) *Attorney, Agent, or Firm*—Brooks & Kushman P.C.

(57) ABSTRACT

A tilt switch includes a central electric contact member and a first electric contact terminal adapted to be mounted on a support. The central electric contact member defines a rolling area. An electrically conductive ball member is rollable on the rolling area. An electrically conductive shell member is mounted on the support to confine an accommodating space for the ball member, and has a second electric contact terminal in electric contact with the first electric contact terminal. Once the rolling area is tilted, the ball member will move by virtue of gravity to contact with an inner peripheral surface of the shell member so as to establish an electrical connection between the central electric contact member with the first electric contact terminal.

6 Claims, 4 Drawing Sheets

TILT SWITCH

BACKGROUND OF THE INVENTION

1. Field of the Invention

This invention relates to a tilt switch, more particularly to a tilt switch which is adapted to be mounted on a support and which will establish an electrical connection between central and surrounding electric contact terminals that are mounted on the support when the support is tilted.

2. Description of the Related Art

A conventional tilt switch generally includes an insulating housing with a bottom-opened accommodating space for receiving an electrically conductive ball member. An insulating cover is disposed to cover the opening and has a plurality of through holes such that a plurality of elongate electric contact terminals can be press fitted within the through holes to contact with the ball member when the housing is in an upright direction. Outside ends of the terminals are soldered on an electric contact member of a circuit board. With such a construction, the conventional tilt switch is complicated and is inconvenient to assemble.

SUMMARY OF THE INVENTION

The object of the present invention is to provide a tilt switch which is simple in construction and which is easy to assemble.

According to this invention, the tilt switch is adapted to be mounted on and to be in electric contact with a support in an upright direction. The tilt switch includes a central electric contact member which is adapted to be disposed on the support, and which defines a rolling area and a central line that extends in the upright direction and normal to the rolling area. A surrounding seat member is adapted to be disposed on the support, and surrounds the central electric contact member. The seat member has at least one first electric contact terminal which is spaced apart from the central electric contact member. An electrically conductive ball member is rollable on the rolling area. An electrically conductive shell member includes a surrounding lower edge which is disposed on the seat member and which has at least one second electric contact terminal that extends radially and outwardly from the surrounding lower edge and that is in electric contact with the first electric contact terminal, and a surrounding wall which extends from the surrounding lower edge in the upright direction and which surrounds the central line to terminate at a surrounding upper edge. The surrounding wall has an inner peripheral surface which faces towards and which surrounds the central line, and which cooperates with the support to confine an accommodating space for rollably accommodating the ball member. The inner peripheral surface is of such a dimension that a shortest one of distances, each of which is measured between two respective points on the inner peripheral surface opposite to each other relative to the central line, is larger than a diameter of the ball member. The ball member is disposed on the rolling area so that when the rolling area remains in a horizontal plane, the ball member is retained on the rolling area without being in contact with the inner peripheral surface. Once the rolling area is tilted from the horizontal plane, the ball member will move by virtue of gravity to contact with the inner peripheral surface so as to establish an electrical connection between the central electric contact member and the first electric contact terminal. A cap member is disposed on and is formed integrally with the surrounding upper edge to prevent movement of the ball member out of the accommodating space in the upright direction without hindering the rolling of the ball member on the rolling area.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
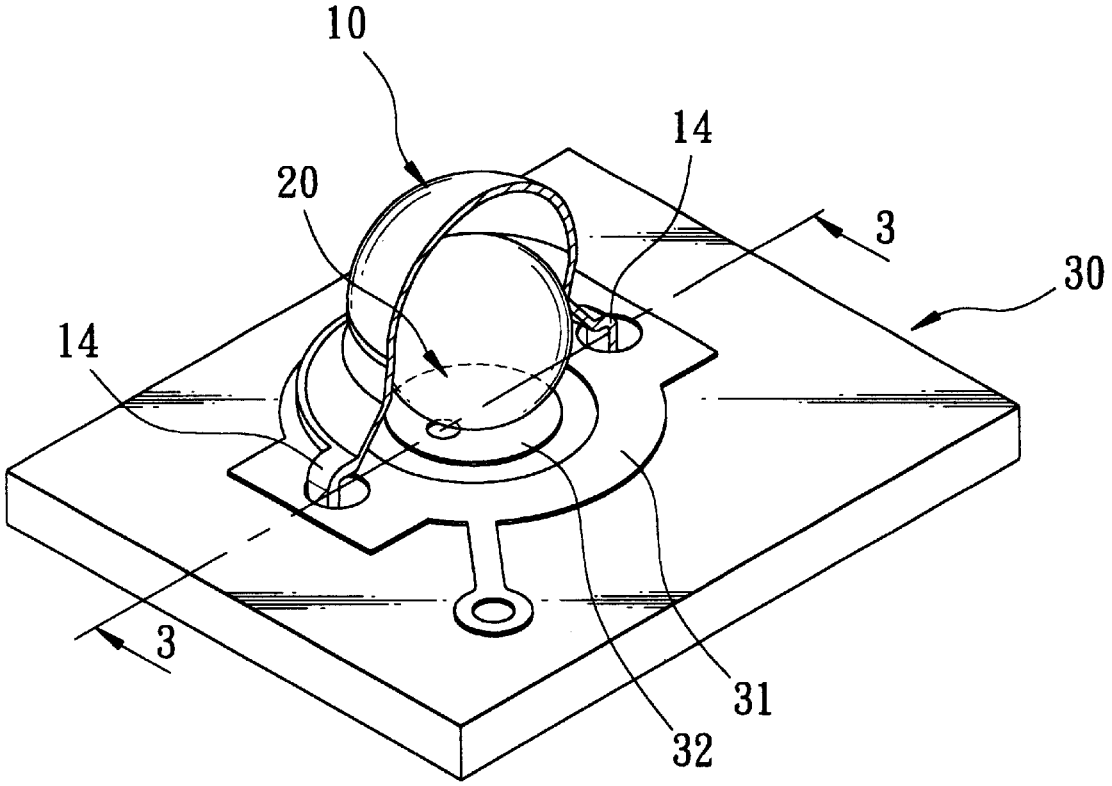
FIG. 1 is a perspective view of a preferred embodiment of a tilt switch according to this invention when mounted on a support.
Figure 2:
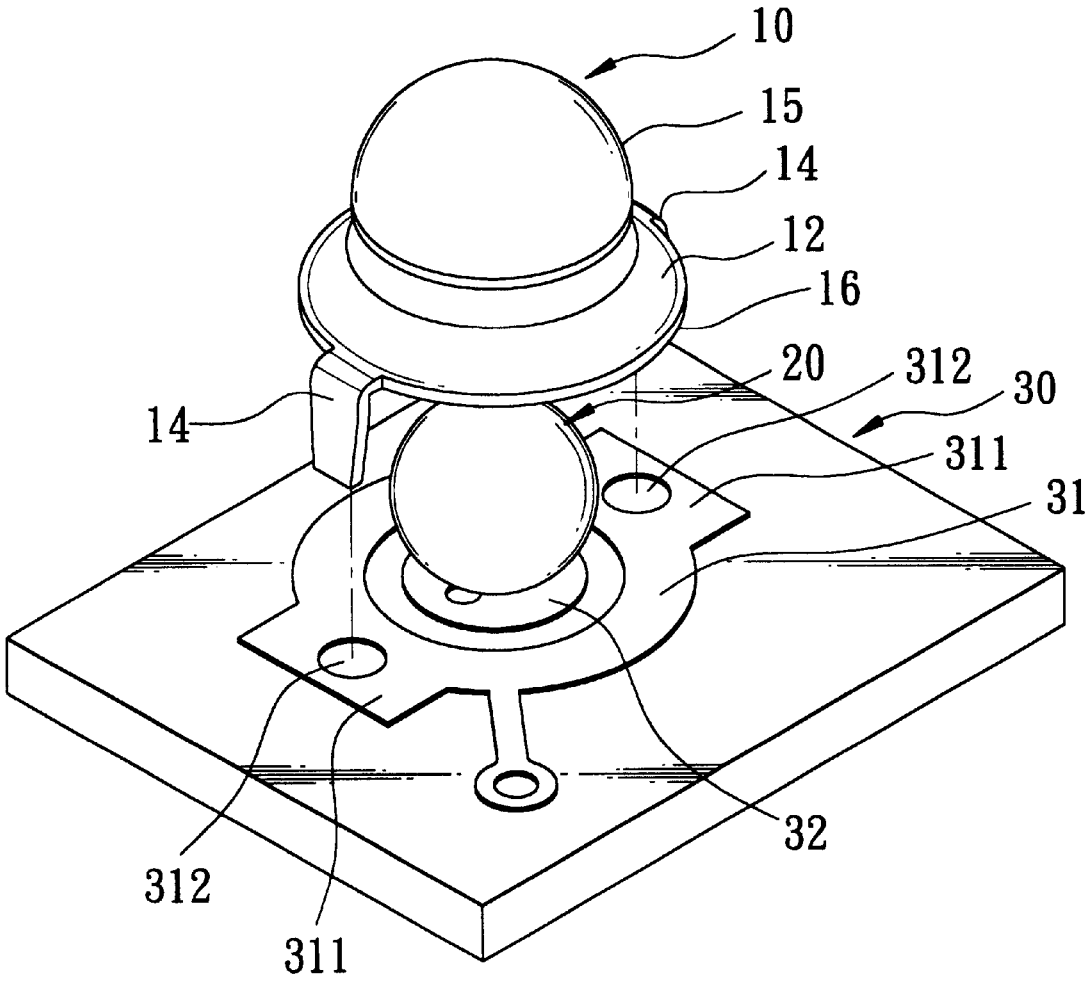
FIG. 2 is an exploded perspective view of the preferred embodiment of this invention.
Figure 3:
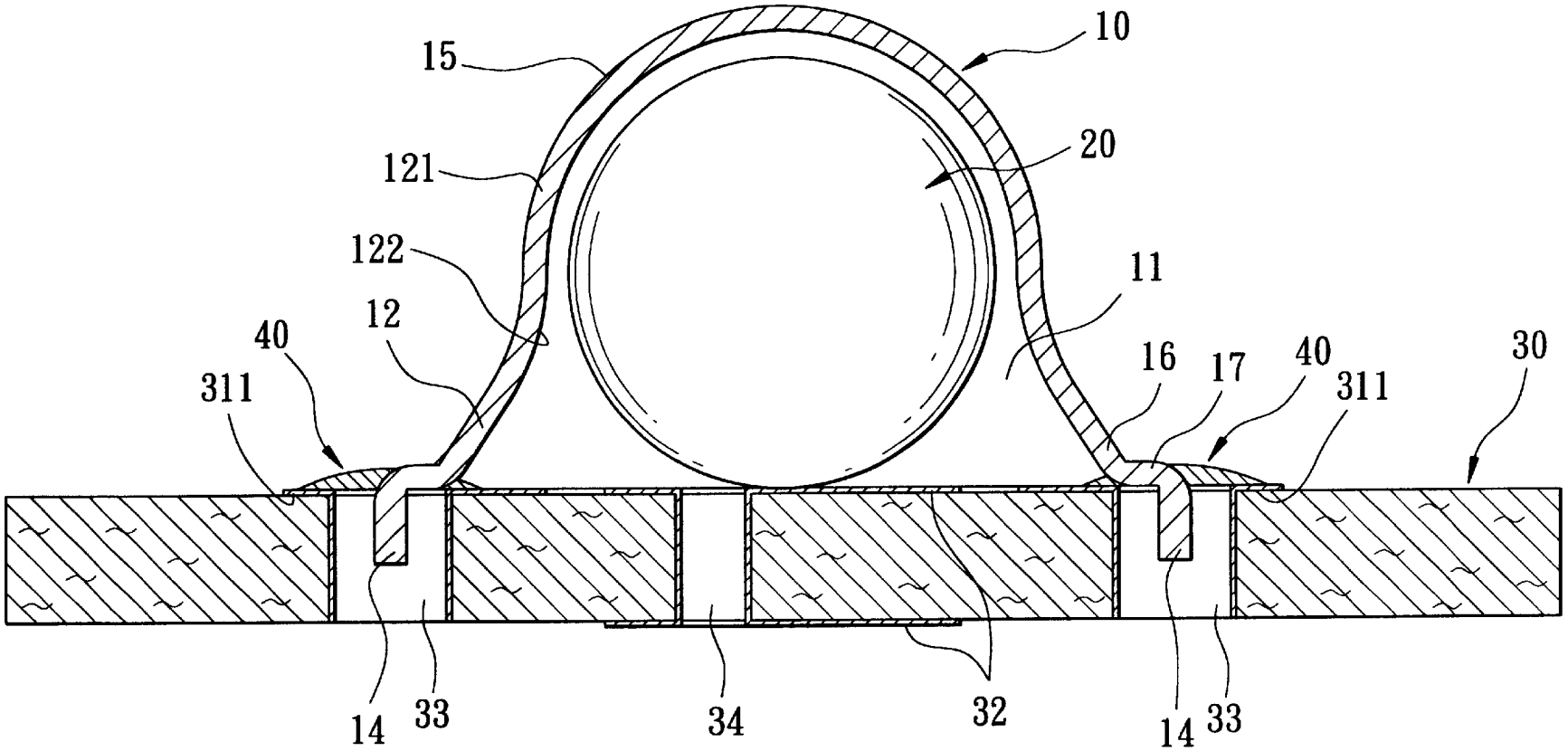
FIG. 3 is a cross-sectional view of the preferred embodiment of this invention, taken along lines 3—3 of FIG. 1.

Referring to FIGS. 1, 2 and 3, the preferred embodiment of the tilt switch according to the present invention is shown to be adapted to be mounted on and to be in electric contact with a support 30, such as a circuit board, in an upright direction. The support 30 has a pair of first holes 33 and a second hole 34 between the first holes 33. The tilt switch is shown to comprise a central electric contact member 32, such as a central copper foil, which is adapted to be attached on an upper major surface of the support 30 to define a rolling area and a central line that extends in the upright direction and that is normal to the rolling area. The central electric contact member 32 extends downwardly in the second hole 34 from the upper major surface and outwardly to a lower major surface of the support 30.

A surrounding seat member 31, such as an annular copper foil, is adapted to be attached on the upper major surface of the support 30, and surrounds and is spaced apart from the central electric contact member 32 radially. The seat member 31 has a pair of first electric contact terminals 311 which are diametrically opposite to each other. Each first electric contact terminal 311 has a through hole 312 which is registered with the first hole 33.

An electrically conductive ball member 20 is made of copper material, and is rollable on the rolling area of the central electric contact member 32.

An electrically conductive shell member 10 includes a surrounding lower edge 16 which is disposed on the seat member 31 and which has a pair of second electric contact terminals 17 that extend radially and outwardly from the surrounding lower edge 16. Each second electric contact terminal 17 has a terminal leg 14 which is inserted through the through hole 312 in the first electric contact terminal 311 and into the first hole 33. An electrically conductive solder material 40 is disposed to interconnect electrically the terminal leg 14 with the first electric contact terminal 311. A surrounding wall 12 extends from the surrounding lower edge 16 in the upright direction, and surrounds the central line of the central electric contact member 32 to terminate at a surrounding upper edge 121. The surrounding wall 12 has an inner peripheral surface 122 which faces towards and which surrounds the central line, and which cooperates with the support 30 to confine an accommodating space 11 for rollably accommodating the ball member 20. The inner peripheral surface 122 of the surrounding wall 12 has such a dimension that a shortest one of distances, each of which is measured between two respective points on the inner peripheral surface 122 opposite to each other relative to the central line, is larger than a diameter of the ball member 20.

Figure 4:
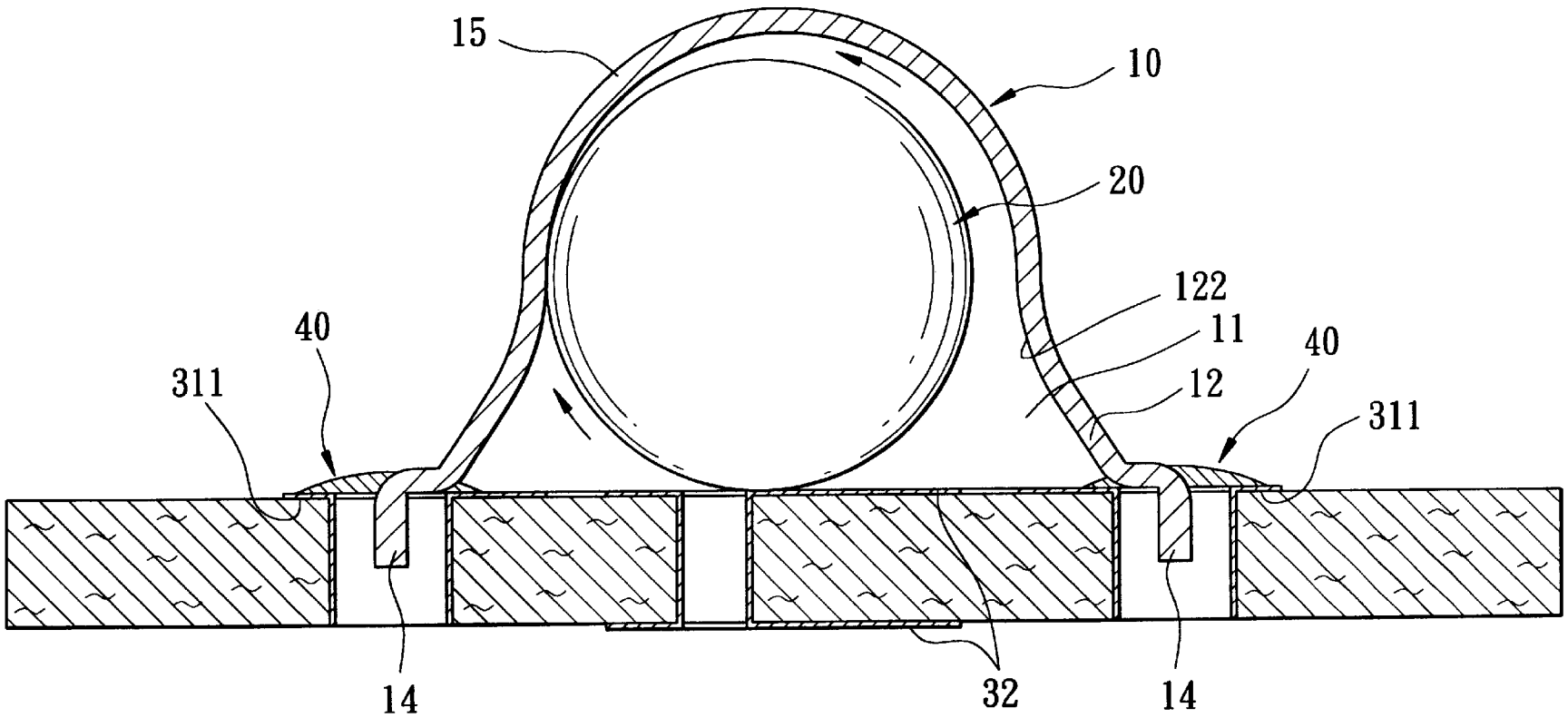
FIG. 4 is a cross-sectional view of the preferred embodiment of this invention in a tilted state.

Thus, the ball member 20 is disposed on the rolling area of the central electric contact member 32 so that when the rolling area remains in a horizontal plane, the ball member 20 is retained on the rolling area without being in contact with the inner peripheral surface 122. As shown in FIG. 4, once the rolling area is tilted from the horizontal plane, the ball member 20 will move by virtue of gravity to contact with the inner peripheral surface 122 so as to establish an electrical connection between the central electric contact member 32 and the first electric contact terminal 311. Preferably, the surrounding wall 12 flares from the surrounding upper edge 121 to the surrounding lower edge 16.

A hemi-spherical cap member 15 is disposed on and is formed integrally with the surrounding upper edge 121 of the surrounding wall 12 to cover the accommodating space 11 so as to prevent movement of the ball member 20 out of the accommodating space 11 in the upright direction without hindering the rolling of the ball member 20 on the rolling area.

In assembly, after the ball member 20 is received in the accommodating space 11, the assembly of the shell member 10 and the ball member 20 is mounted on the support 30. The terminal legs 14 are inserted into the respective holes 312,14 and are connected securely to the first electric contact terminals 311 by the solder materials 40. As such, the tilt switch of this invention has a simple construction that is easy to assemble. The tilt switch of this invention can be applied to a warning device, a toy, a security system, etc.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

We claim:

1. A tilt switch mountable on and to be in electric contact with a support in an upright direction, said tilt switch comprising:

a central electric contact member disposable on the support, and defining a rolling area and a central line extending in the upright direction and normal to said rolling area;

a surrounding seat member be disposed on the support and surrounding said central electric contact member, said seat member having at least one first electric contact terminal which is spaced apart from said central electric contact member;

an electrically conductive ball member rollable on said rolling area;

an electrically conductive shell member including a surrounding lower edge disposed on said seat member and having at least one second electric contact terminal which extends radially and outwardly from said surrounding lower edge and which is in electric contact with said first electric contact terminal, and a surrounding wall extending from said surrounding lower edge in the upright direction and surrounding the central line to terminate at a surrounding upper edge, said surrounding wall having an inner peripheral surface which faces towards and which surrounds the central line, and which cooperates with the support to confine an accommodating space for rollably accommodating said ball member, said inner peripheral surface being of such a dimension that a shortest one of distances, each of which is measured between two respective points on said inner peripheral surface opposite to each other relative to the central line, is larger than a diameter of said ball member, said ball member being disposed on said rolling area so that when said rolling area remains in a horizontal plane, said ball member is retained on said rolling area without being in contact with said inner peripheral surface, and that once said rolling area is tilted from the horizontal plane, said ball member will move by virtue of gravity to contact with said inner peripheral surface so as to establish an electrical connection between said central electric contact member and said first electric contact terminal; and a cap member disposed on and formed integrally with said surrounding upper edge to prevent movement of said ball member out of said accommodating space in the upright direction without hindering the rolling of said ball member on said rolling area.

2. The tilt switch of claim 1, wherein said surrounding wall flares from said surrounding upper edge to said surrounding lower edge.

3. The tilt switch of claim 2, wherein said central electric contact member is a central copper foil attachable on the support, said surrounding seat member being an annular copper foil surrounding and spaced apart from said central copper foil radially.

4. The tilt switch of claim 3, wherein said first electric contact terminal has a through hole, said second electric contact terminal having a terminal leg which is inserted into said through hole toward the support, and an electrically conductive solder material which is disposed to interconnect electrically said terminal leg with said first electric contact terminal.

5. The tilt switch of claim 4, wherein said ball member is made of copper material.

6. The tilt switch of claim 5, wherein said cap member is hemi-spherical in shape.

* * * * *